United States Patent [19]

Ikeura

[11] 4,365,599

[45] Dec. 28, 1982

[54] OPEN AND CLOSED LOOP ENGINE IDLING SPEED CONTROL METHOD AND SYSTEM FOR AN AUTOMOTIVE INTERNAL COMBUSTION ENGINE

[75] Inventor: Kenji Ikeura, Yokosuka, Japan

[73] Assignee: Nissan Motor Company, Limited, Kanagawa, Japan

[21] Appl. No.: 146,427

[22] Filed: May 5, 1980

[30] Foreign Application Priority Data

May 9, 1979 [JP] Japan ..... 54-55670
May 21, 1979 [JP] Japan ..... 54-61510

[51] Int. Cl.[3] ..... F02B 3/08; F02M 7/12; F02B 75/10; F02D 1/04

[52] U.S. Cl. ..... 123/339; 123/340; 123/587; 123/489

[58] Field of Search ..... 123/339, 340, 349, 395, 123/440, 489, 585, 586, 587, 588, 589

[56] References Cited

U.S. PATENT DOCUMENTS

| | | | |
|---|---|---|---|
| 4,167,396 | 9/1979 | Kondo et al. | 123/489 |
| 4,170,201 | 10/1979 | Camp et al. | 123/489 |
| 4,186,691 | 2/1980 | Takase et al. | 123/340 |
| 4,191,051 | 3/1980 | Kawada et al. | 123/340 |
| 4,237,838 | 12/1980 | Kinagawa et al. | 123/339 |
| 4,240,145 | 12/1980 | Tano et al. | 123/587 |
| 4,244,023 | 1/1981 | Johnson | 123/340 |
| 4,248,196 | 2/1981 | Toelle | 123/489 |

FOREIGN PATENT DOCUMENTS

| | | |
|---|---|---|
| 1470642 | 4/1977 | United Kingdom . |
| 2012997 | 8/1979 | United Kingdom . |

*Primary Examiner*—Raymond A. Nelli
*Attorney, Agent, or Firm*—Lowe, King, Price & Becker

[57] ABSTRACT

An intake air flow rate control method system for an internal combustion engine includes a valve which is provided with an electromagnetically operated actuator responsive to a control signal. The control system identifies a control signal for controlling actuation of the actuator and thereby for controlling the air flow rate generating the control signal indicative of the control. The display selectively carries out closed loop (feedback) control and open loop control corresponding to engine driving conditions. Feedback control is carried out when the engine driving condition is stable (in steady state). To determine a suitable condition control for closed loop, a throttle valve closed position, a transmission neutral, and a vehicle speed are checked. When the throttle valve is closed and the transmission is in neutral, the vehicle speed is less than 8 km/h and/or the fuel supply occurs shut off, a decision to carry out feedback (closed loop) control is made. Thus, according to the present method and system, control of the air flow rate can be effectively and successfully switched corresponding to engine driving condition.

12 Claims, 5 Drawing Figures

OPEN AND CLOSED LOOP ENGINE IDLING SPEED CONTROL METHOD AND SYSTEM FOR AN AUTOMOTIVE INTERNAL COMBUSTION ENGINE

BACKGROUND OF THE INVENTION

1. Field of the Invention

The present invention relates generally to an intake air flow rate control system for an internal combustion engine of an automotive vehicle. More specifically, the present invention relates to a means for determining feedback control condition of the engine in a microcomputer implemented air flow rate control system.

2. Description of the Prior Art

In recent years, pollution of the atmosphere by nitrogen oxides $NO_x$, carbon monoxide CO, gaseous sulfurous acid and so on produced in the exhaust gas of automotive vehicles has become a serious social problem. In addition to this, the price of fuel, i.e. gasoline or petrol, for automotive vehicles has become higher and higher, because of the limited resources thereof. For preventing atmospheries pollution caused by exhaust gas of vehicles and for using fuel economically, it has become necessary for current automotive vehicles to control engine speed accurately even when the vehicle engine is idling.

SUMMARY OF THE INVENTION

The present invention comprises a method of and system for controlling engine speed during idling by controlling air flow rate through an idle port passage and a bypass passage which bypasses the throttle valve in an intake air passage.

In the intake air flow rate control system, it is preferable to carry out either feedback (closed loop) control or open loop control selectively, according to engine driving conditions. Since, in feedback, or closed loop, control, a control signal is determined corresponding to the actual engine speed and the difference between the actual engine speed and the reference engine speed determined corresponding to the coolant temperature, it will be essential in order to carry out feedback control that the engine driving condition is sufficiently steady or stable. Therefore, it is necessary to detect engine driving conditions; the detected conditions are discriminated so as to effect feedback control only when the engine is being driven stably i.e., in a steady fashion.

In a conventional system, whether the engine driving condition is suitable for feedback control is determined according to opening or closing of the throttle valve. However, when the engine is decelerating, the throttle valve may be closed. Several engine driving conditions that are too transient or is not sufficiently stable to carry out feedback control include, when the engine speed is decelerated from a relatively high speed and when the engine speed is excessively increased without applying a load, e.g. a pulse clutch is disengaged or the transmission is in neutral. In these instances, the control signal will be excessively varied so as to cause unstable control conditions and also an increase of harmful components in the exhaust gas. Moreover, frequently varying the control signal may possibly cause the engine to stall. For preventing such a possibility, it is necessary to discriminate engine driving conditions corresponding to the conditions of various control parameters.

The present invention seeks to provide an intake air flow rate control system in which engine driving condition is discriminated with respect to the actual engine speed, transmission gear position vehicle speed and so on as well as the throttle valve position.

Therefore, it is an object of the present invention to provide a control method and system for controlling an intake air flow rate for an internal combustion engine, which system is capable of discriminating engine driving conditions and selectively carrying out feedback and open loop control operation according to the discriminated engine driving conditions.

Another object of the present invention is to provide a control method and system for the intake air flow rate for an internal combustion engine, wherein engine driving condition is discriminated with respect to required air flow rate determined by a fuel injection system in the known manner, as well as with respect to transmission gear position, the vehicle speed, fuel supply conditions, the actual engine speed and the difference between the actual engine speed and the reference engine speed determined corresponding to the coolant temperature and corrected with respect to various control parameters, such as kind of transmission, the transmission gear position, air conditioner operating condition and so on.

A further object of the present invention is to provide a control method and system of the intake air control method and system which can switch control operation from open loop control to feedback control in response to a discriminated driving condition which is sufficiently stable to allow feedback control.

According to the present invention, therefore, there is provided a microcomputer implemented control method and system for controlling an intake air flow rate for an internal combustion engine. The method and system include a means for determining whether the engine driving conditions are suitable for feedback control to be carried out. The means discriminates the engine driving condition with respect to various control parameters such as transmission gear position, vehicle speed, actual engine speed and so on. According to various combinations of the various engine control parameters, the discriminating means determines whether the engine driving condition is stable, i.e., steady enough to provide reliable feedback control and thereby switches operation from open loop control to feedback control when the engine driving condition is stable, and from feedback control to open loop control otherwise. Thus, by the control system according to the present invention, feedback control and open loop control can be effectively and satisfactorily switched corresponding to the engine driving conditions.

The other objects and advantages sought in the present invention will become apparent from the description given herebelow.

BRIEF DESCRIPTION OF THE DRAWINGS

The present invention will become more fully understood from the detailed description given below, and from the accompanying drawings of the several preferred embodiments of the present invention, which, however, are not to be taken as limitative of the present invention in any way, but are for the purpose of elucidation and explanation only.

In the drawings.

DESCRIPTION OF THE PREFERRED EMBODIMENT

Figure 1:
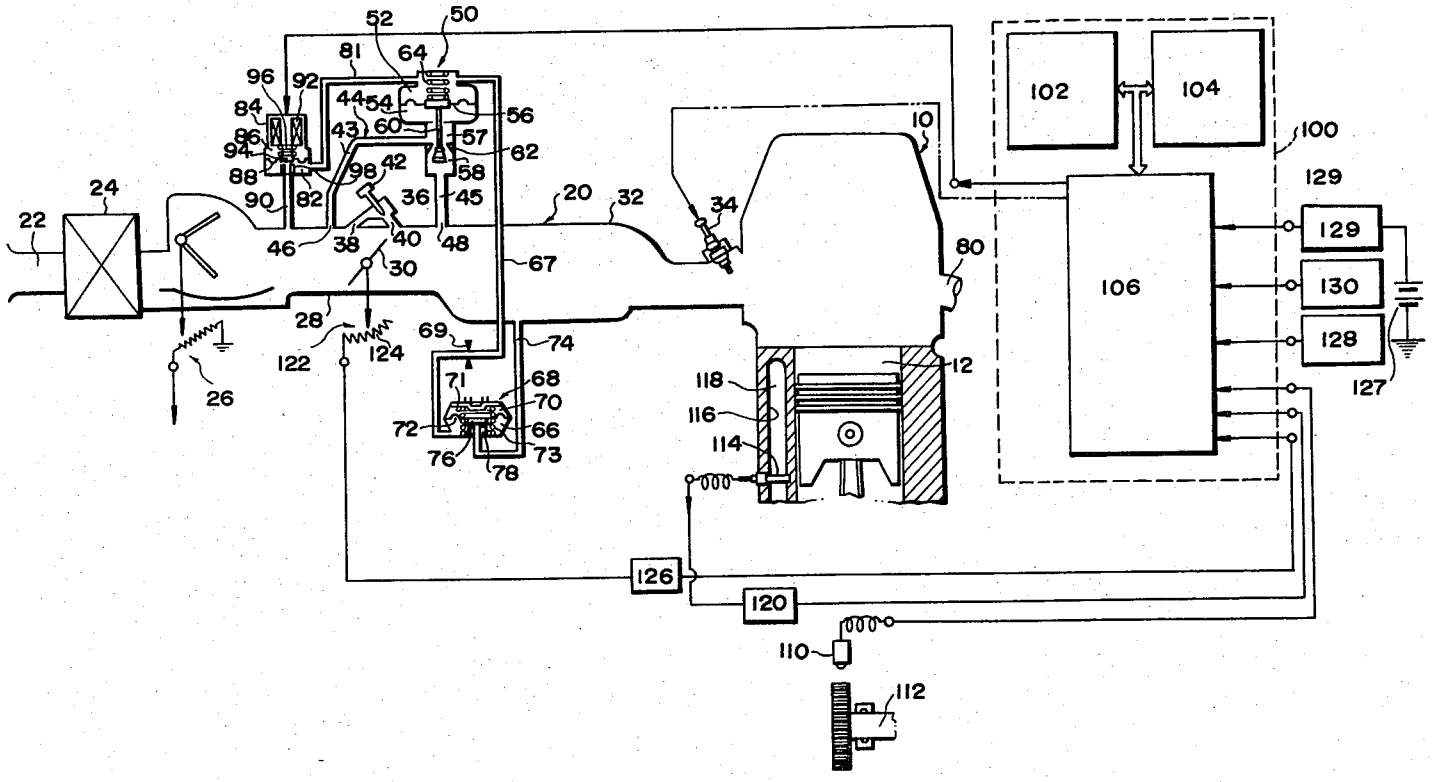
FIG. 1 is a diagramatical view of an intake air flow rate control system for an internal combustion engine according to the preferred embodiment of the present invention.

Referring now to the drawings, and particularly to FIG. 1, in which is illustrated and shown the general construction of an internal combustion engine having a computer controlled fuel injection system, to be provided on an automotive vehicle: an air flow rate control system according to the present invention is shown as applied to this internal combustion engine, as an example and for the purposes of explanation only, and should not be taken as limitative of the scope of the present invention. Before moving onto the detailed description, it should be appreciated that the air flow rate control system according to the present invention will be applicable to any type of internal combustion engine which can be controlled by a microcomputer mounted on the vehicle.

In FIG. 1, each of the engine cylinders 12 of an internal combustion engine 10 communicates with an air intake passage generally designated by 20. The air intake passage 20 comprises an air intake duct 22 with an air cleaner 24 for cleaning atmospheric air, an air flow meter 26 provided downstream of the air intake duct 22 to measure the amount of intake air flowing therethrough, a throttle chamber 28 in which is disposed a throttle valve 30 cooperatively coupled with an accelerator pedal (not shown), so as to adjust the flow rate of intake air flowing therethrough, and an intake manifold 32 having a plurality of branches not clearly shown in FIG. 1. Although there is not clearly illustrated in FIG. 1, the air flow meter is incorporated with another engine control system which determines fuel injection rate, for example. A fuel injector 34 is provided on the intake manifold 32. The rate of injection of fuel through the fuel injector 34 is controlled by an adjusting, such as, an electromagnetic actuator (not shown). The adjusting is electrically operated by the other control system which determines fuel injection rate, fuel injection timing and so on corresponding to engine condition sensed by various engine parameter sensing means. It should be noted that, although the fuel injector 34 is disposed on the intake manifold 32 in the shown embodiment, it is possible to locate it in the combustion chamber 12 in a per se well known manner.

An idle port passage 36 is provided opening into the throttle chamber 28. One end port 38 of the idle port passage 36 opens upstream of the throttle valve 30, and the other end port 40 opens downstream of the throttle valve 30, so that the idle port passage 36 bypasses the throttle valve 30. An idle adjusting screw 42 is provided in the idle port passage 36. The idle adjusting screw 42 is manually operable, so as to adjust the flow rate of intake air flowing through the idle port passage 36. A bypass passage 44 is also provided to the intake air passage 20. One end 46 of the bypass passage 44 opens between the air flow meter 26 and the throttle valve 30 and the other end 48 opens downstream of the throttle valve 30, adjacent to the intake manifold 32. Thus the bypass passage 44 bypasses the throttle valve 30 and connects the upstream of the throttle valve 30 to the intake manifold 32. An idle control valve, generally designated by 50, is provided in the bypass passage 44. The idle control valve 50 generally comprises two chambers 52 and 54 separated by a diaphragm 56. The chamber 54 communicates with the atomosphere. The bypass passage 44 is thus separated by the valve means 50 into two portions 43 and 45 respectively located upstream and downstream of the port 57 of the valve 50. The valve means 50 includes a poppet valve 58 disposed within the portion 57 in a manner that it is movable between two position, one being opening the valve to establish communication between the portions 43 and 45 of the passage 44 and the other being closing the same. The poppet valve element 58 has a stem 60 whose end is secured to the diaphragm 56 so as to cooperatively move therewith. The diaphragm 56 is biased downwards in the drawing, so as to release the valve element 58 from a valve seat 62, by a helical compression coil spring 64 disposed within the chamber 52 of the valve means 50. Thereby, the valve 50 is normally opened, and normally communicates the portions 43 and 45 of the bypass passage 44 to one another, via its valve port 57.

The chamber 52 of the idle control valve 50 communicates with one chamber 66 of a pressure regulating valve 68 as the constant vacuum source through a vacuum passage 67. The pressure regulating valve 68 is separated into two chambers 66 and 70 by a diaphragm 72. The chamber 66 of the pressure regulating valve 68 is also communicated with the intake manifold 32, so as to introduce vacuum from the intake manifold 32 thereinto, through a passage 74. The chamber 70 is open to the atmosphere in a per se well known manner. To the diaphragm 72 is secured a valve member 76 which is opposed to a valve seat 78 provided at the end of the passage 74. In the chambers 66 and 70 there are respectively disposed helical compression coil springs 71 and 73. The springs 71 and 73 are generally of equal spring pressure in a position in which the diaphragm 72 is in neutral position. It will be noted that, though it is not so shown, the chamber 66 can also be connected with an exhaust-gas recirculation (EGR) control valve which recirculates a part of the exhaust gases flowing through an exhaust passage 80 to the intake manifold 32.

The diaphragm 72 is moved upwards or downwards by change of the balance of the vacuum in the chamber 66 and the atmospheric pressure introduced into the chamber 70. By this moving of the diaphragm 72, the valve member 76 is moved toward or away from the valve seat 78, so as to regulate a reference vacuum for the idle control valve 50. The reference vacuum regulated in the pressure regulating valve means 68 is introduced to the chamber 52 of the idle adjusting valve means 50 through the vaccum passage 67 with an orifice 69. The orifice 69 restricts varying of vacuum flowing into the chamber 52 so as to make smooth the valve operation.

The chamber 52 of the idle control valve 50 is further communicated with a chamber 82 of an intake air valve 84 through an air passage 81. The intake air valve means 84 is divided into two chambers 82 and 86 by a diaphragm 88. The chamber 82 is also communicated with the air intake passage 20 upstream of the throttle valve 30 through a passage 90. An electromagnetic actuator 92 is disposed within the chamber 86 and is electrically operated in response to a train of pulse signals generated based on a control signal from the control signal generator in a hereinafter described control unit in use with a microcomputer. On the diaphragm 88 is provided a valve member 94 which is electromagnetically moved by the actuator 92. In practice, by varying the pulse width based on the control signal, the ratio of the energized period and deenergized period of the actuator 92 is varied. Therefore the ratio of the opening period and the closing period of the valve 94 is varied so as to control the flow rate of the air flowing through the intake air valve 84. In the chamber 86 is further provided a helical compression coil spring 96 which biases the diaphragm together with the valve member 94 toward the end of the passage 90, so as to seat the valve member 94 onto a valve seat 98 provided at the end of the passage 90. By the vacuum from the pressure regulating valve 68, the diaphragm 56 together with the valve element 58 are moved to control the flow of air through the bypass 44. The vacuum in the chamber 52 is controlled with controlling the flow rate of the air flowing through the intake air valve 84 and the air passage 81.

When the internal combustion engine 10 is in idling condition, the throttle valve 30 is generally closed so as to restrict the flow of intake air therethrough. Therefore, during idling condition of the internal combustion engine 10, the intake air substantially flows through both the idle port passage 36 and the bypass passage 44, which bypass the throttle valve 30 and connect the upstream and the downstream of the throttle valve 30. Air flow rate through the idle port passage 36 is adjusted by the idle adjusting screw 42, and the air flow rate through the bypass passage 44 is generally controlled by the idle control valve 50. The idle control valve 50 is operated by vacuum fed from the intake manifold 32 through the passage 74, the pressure regulating valve 68, and the vacuum passage 67. The vacuum in the chamber 52 is adjusted by the atmospheric intake air flowing thereinto through the passage 90, the electromagnetic valve 84 and the passage 81. The valve element 58 is operated to controll the air flow rate flowing through the passage 44 by the vacuum within the chamber 52. Since the engine speed depends on the intake air flow rate, it can thus be controlled by controlling the air flow rate through the idle port passage 36 and the bypass passage 44 when the internal combustion engine 10 is in idling condition.

It should be noted that, though the control operation for adjusting the intake air flow rate performed by controlling the electromagnetic actuator 92 is described hereafter, the controlling of air flow rate, and thus the control of engine speed during idling condition of the internal combustion engine 10, can also be carried out by manually controlling the idle adjusting screw 42. The idle adjusting screw 42 is provided basically for the purpose of the initial idling speed setting.

Now, returning to FIG. 1, a microcomputer 100, employed for automatically controlling the air flow rate, comprises generally a central processing unit (CPU) 102, a memory unit 104, and an input/output unit 106 i.e. an interface. As inputs of the microcomputer 100, there are various sensor signals, such as:

- a crank pulse and a crank standard pulse, the crank pulse being generated at every one degree or certain degree more than one of the crank angle, and the crank standard pulse being generated at every given crank standard angle by a crank angle sensor 110 detecting the amount of rotation of a crank shaft 112; the crank pulse and the crank standard pulse are inputted as an input indicating engine speed and engine crank position;
- a coolant temperature signal, produced by a temperature sensor 114 which is inserted into a coolant passage 116 provided around the engine cylinder 12, and exposed to the coolant 118; the temperature sensor 114 generates an analog signal in response to the coolant temperature and feeds this signal to the input/output unit 106 through an analog-digital converter (A/D converter) 120, in which the coolant temperature signal is converted into a digital code a binary number signal, which is suitable as an input for the microcomputer.
- a throttle valve angle signal, derived from an analog signal produced by a throttle valve angle sensor 122 which comprises a variable resistor 124 and converted into digital code by an A/D converter 126,
- a signal from a transmission neutral switch 128, which is inputted in the form of an ON/OFF signal,
- a vehicle speed signal, fed from a vehicle speed sensor 130, which is an ON/OFF signal which becomes ON when the vehicle speed is lower than a given speed, e.g., 8 kph, and is OFF otherwise,
- and a battery voltage signal, fed from the battery 127 through the A/D converter 129. It will be appreciated that, although, in the shown embodiment, there is employed a variable resistor 124 in the throttle valve angle sensor 122 for detecting the closed position of the throttle valve, an ON/OFF switch could substitute for the variable register 124, which could become ON when the throttle valve 30 is in the closed position.

Figure 2:
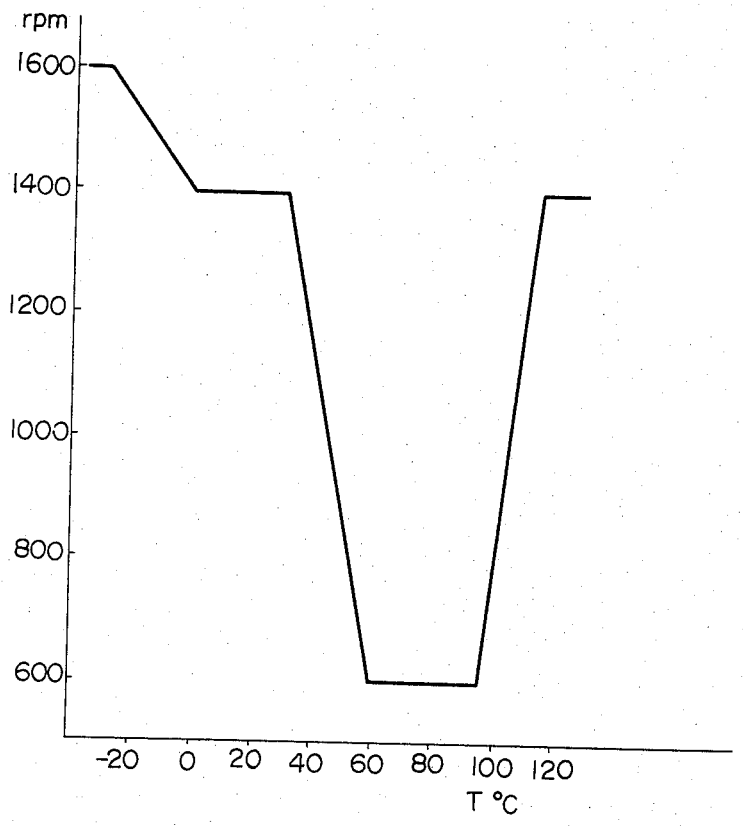
FIG. 2 is a graph showing reference engine speed selected as a function of coolant temperature.

FIG. 2 shows a relationship between the coolant temperature T and the reference engine speed $N_{SET}$, as an example of control characteristics, under the condition of the open-loop control, according to the present invention. The reference engine speed $N_{SET}$ is the desirable engine speed corresponding to the coolant temperature. The pulse duty cycle of the pulse signal applied to the actuator 92 is determined based on the control signal which corresponds to the reference engine speed $N_{SET}$ in open-loop control. Although the control characteristics according to the present invention are described hereafter with respect to an example using the coolant temperature as a control parameter to determine the desired reference engine speed $N_{SET}$, it will be possible to use other factors as the control parameter. For example, engine temperature can also be used as the control parameter for determining the reference engine speed $N_{SET}$.

As shown in FIG. 2, according to the present invention, in a normal driving condition in which the coolant is warmed-up to 60° C. to 95° C., the idling engine speed is maintained at 600 r.p.m. When the coolant temperature is higher than the abovementioned normal range and is thereby over-heated, the reference idling engine speed is increased to the maximum 1400 r.p.m. so as to increase coolant velocity and to increase the amount of cooling air passing a radiator (not shown) for effectively cooling the internal combustion engine. On the other hand, if the coolant temperature is lower than that of the normal range, the reference idling speed is also increased to the maximum 1600 r.p.m. so as to warm-up the engine rapidly and to stabilize idling engine speed in the cold engine condition. One of the most important concepts of the present invention is to specify the reference engine speed at a specific cold temperature range of the coolant. According to the present invention, the specific temperature range is 0° C. to 30° C. and the specific reference engine speed in the specific temperature range is 1400 r.p.m. The specific reference engine speed is kept constant within the above-mentioned specific temperature range. The reason for specifying the coolant temperature range and constant engine speed within this range is that, except in extraordinarily cold weather, the coolant temperature is normally in this range when the engine is started first.

In practical control operation with a microcomputer, the reference engine speed is determined in either of two ways; i.e., open-loop control and feedback control. In the feedback control, the pulse duty (the ratio of the pulse width to one pulse cycle) of the pulse signal to be fed back to the electro-magnetic valve means 84 is determined base on the control signal which does not correspond to the reference engine speed $N_{SET}$ like in open-loop control and which is determined according to the difference between the actual engine speed and the reference engine speed. The feedback control is carried out according to the position of the throttle valve detected or measured by the throttle valve angle sensor 122, the position of the transmission detected by the neutral switch 128, the vehicle speed detected by the vehicle speed switch sensor 130 and so on. In any case, the feedback control to be carried out will be determined with reference to vehicle driving conditions which will be preset in the microcomputer, for example the condition in which the throttle valve is closed and the transmission is in neutral position or the condition in which the throttle valve is closed and the vehicle speed is below 8 km/h. When the vehicle driving condition is not adapted to carry out feedback control, then the microcomputer performs open loop control by table look-up. In open loop control, the reference engine speed $N_{SET}$, i.e. the control signal, is determined with reference to the coolant temperature by table look-up. As appearent from the above, the control signal is the signal which determines the pulse duty of the pulse signal.

The table data is stored in the ROM of the memory unit 104. The table data is looked-up according to the coolant temperature. The following table shows the relationship between the coolant temperature (TW) and corresponding reference engine speed $N_{SET}$, when the table is preset in 32 bytes of ROM.

TABLE

| Coolant temperature TW (°C.) | Reference engine speed $N_{SET}$ (rpm) | Coolant temperature TW | Reference engine speed $N_{SET}$ |
|---|---|---|---|
| 117 and over | 1400 | 36.5 | 1225 |
| 104 | 1000 | 33 | 1325 |
| 94 | 600 | 29.5 | 1400 |
| 80 | 600 | 22 | 1400 |
| 59.5 | 600 | 10 | 1400 |
| 55.5 | 725 | 1 | 1400 |
| 51.5 | 837.5 | −4 | 1425 |

TABLE-continued

| Coolant temperature TW (°C.) | Reference engine speed $N_{SET}$ (rpm) | Coolant temperature TW | Reference engine speed $N_{SET}$ |
|---|---|---|---|
| 47.5 | 937.5 | 10.5 | 1475 |
| 43.5 | 1012.5 | 18.5 | 1525 |
| 40.5 | 1100 | −30 and less | 1600 |

It should be appreciated that in the example shown, the engine speed is increased in steps of 12.5 r.p.m. If the coolant temperature is intermediate between two given values, the reference engine speed $N_{SET}$ will be determined by interpolation.

The reference engine speed should be corrected corresponding to a load applied to the engine so as to accurately adapt the engine speed to that of required. There are various factors to vary the load applied to the engine, such as kind of transmission, the transmission gear position, operating condition of an air conditioner. With respect to corrected reference engine speed, the pulse duty of the pulse signals to be applied to the actuator 92 is determined.

However, in the present control system, two different control operations, i.e. the feedback control and the open loop control, are carried out selectively. Feedback control should be carried out under stable engine driving conditions, since, in this control operation, the control signal is determined corresponding to the actual engine speed and the difference between the reference engine speed and the actual engine speed. If feedback control is used under unstable engine driving condition, in which the actual engine speed is frequently varied, the control signal is unnecessarily varied to possibly cause the engine to stall, and increase the harmful components in the exhaust gas. For determining stable engine driving conditions suitable for feedback control, various engine control parameters will be checked.

Now we explain discrimination for selectively carrying out feedback and open loop control operations. The discriminating operation is carried out by the microcomputer 100. Basically, feedback control is used when the throttle valve is entirely closed, in other words, when the throttle valve angle sensor 122 of FIG. 1 is turned ON (hereinafter referred as FACTOR I). Additionally, it is necessary to carry out feedback control when the engine is stably driven. Therefore, for discriminating whether the vehicle condition is adapted to allow feedback control, a combination of various factors should be adapted to specific condition therefor. For determining a feedback control condition, the throttle valve angle sensor 122 signal, neutral safety switch 128 signal of a power transmission, and vehicle speed switch 130 signal are checked. Additionally, whether a clutch position switch is turned ON, corresponding to the clutch being disengaged is checked. Further, the presence of a fuel cut signal generated by the fuel supply system is checked.

If the neutral safety switch 128 is turned ON which indicates that the transmission is in neutral, no load is applied to the engine. This (hereinafter referred as FACTOR II) is adapted to carry out feedback control.

When the vehicle speed is less than a given speed, e.g., 8 km/h, the vehicle speed switch turns ON. In this condition (hereinafter referred to as FACTOR III), a load may be applied to the engine but the vehicle speed is substantially low. In this condition, the feedback control can also take place.

When the clutch position switch is turned ON (hereinafter referred to as FACTOR V), similar to FACTOR II, the feedback control can take place.

If the fuel supply system is in the fuel shut off position, this generally means that the vehicle is being decelerated. When the vehicle is being decelerated, feedback control can not be carried out. Therefore, to carry out feedback control, the fuel supply system should not be in the fuel shut off position (hereinafter referred as FACTOR VI).

Even after some combinations of the factors adapted to feedback control are set, a time delay is required to stabilize the engine condition. For avoiding errors in control, particularly upon changing from open loop to feedback control, it is required for the engine to be stable or in reasonably steady operation. For example, when the vehicle is being decelerated, the engine is driven by the vehicle action, that is engine-braking, the engine speed is lowered excesively to cause instability for a period of time. Further, for example, after the engine speed is increased to a substantially high speed without applying a load, it also takes a time to return to stable conditions. Therefore, in the preferred embodiment of the present invention is provided a transient delay time to enter into feedback control. For example, the transient delay time may be 4 seconds from the other factors adapted to feedback control. After expiration of the transient delay time (hereinafter referred as FACTOR IV), feedback control is carried out.

With respect to discrimination of the vehicle conditions for carrying out feedback control, there are various combinations to be checked, such as:

(a) FACTOR I AND (FACTOR II OR FACTOR III) AND FACTOR IV (b) FACTOR I AND (FACTOR II OR FACTOR V) AND FACTOR IV (c) FACTOR I AND (FACTOR II OR FACTOR III) AND FACTOR VI

It will be understood that throughout this specification, in such contexts as this, the word "OR" will be given its inclusive meaning, that is to say will not exclude both conditions from holding.

In combination (a), when the throttle valve is entirely closed, the transmission is in neutral position or the vehicle speed is less than 8 km/h, and the transient delay time expires, feedback control is carried out. In combination (b), FACTOR III of combination (a) is replaced by FACTOR V. Since FACTOR III and FACTOR V are similar at least in so far as the engine is not in engine-braking position, conditions (a) and (b) are similar. It should be noted that FACTOR II is also the same kind of factor being capable of substitution for the FACTOR III and FACTOR V. Therefore, although not listed specifically here, various combinations adapted for determination of vehicle conditions will be apparent to those skilled in the art.

In combination (c), FACTOR IV is replaced by FACTOR VI. Since the FACTOR VI indicates that the fuel supply is not shut off, namely the FACTOR VI indicates the vehicle is not decelerated, the engine can be regarded as stable by combination with other factors.

Alternatively, when the engine control is changed from feedback control to open loop control, it is of course possible to discriminate the condition by discriminating one or more factors not adapted to perform feedback control. However, in practice, when the control changes from feedback to open loop, first FACTOR I will change so as not to be adapted to feedback control and the remaining factors will be changed following the change in FACTOR I. Therefore, indeed, it is possible to detect the engine condition to change control from the feedback to the open loop by merely determining that FACTOR I is not satisfied.

Figure 3:
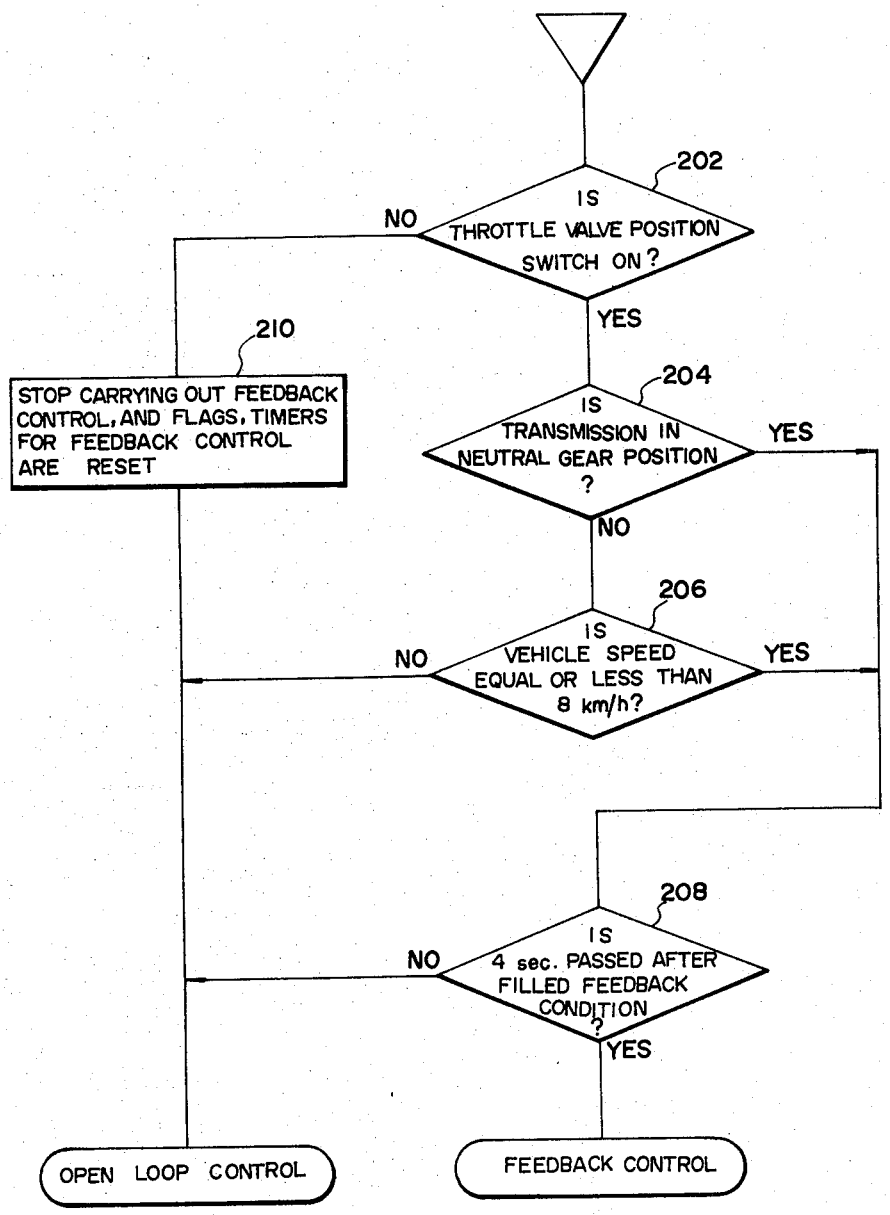
FIG. 3 is a flowchart of a program for discriminating the engine driving condition according to a first embodiment of the present invention, wherein the throttle valve switch, transmission gear position, vehicle speed and transient delay time are used as engine condition discriminating factors.
Figure 4:
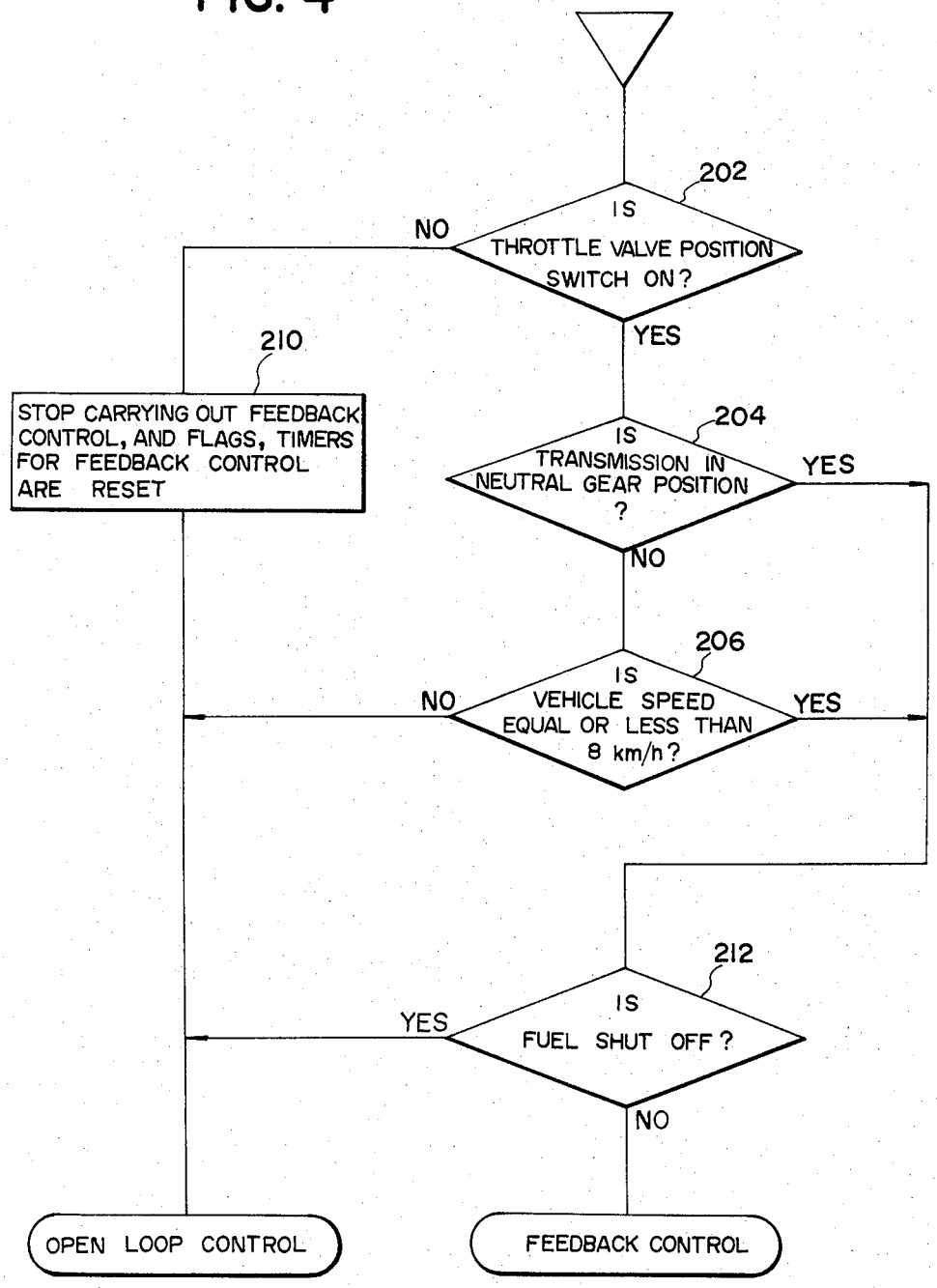
FIG. 4 is a flow chart of a modified program of FIG. 3, wherein the transient delay time as the discriminating factor is replaced by a fuel supply condition.

Referring now to FIGS. 3 and 4, there are illustrated flowcharts of programs for discriminating the engine condition. FIG. 3 shows a program for checking the foregoing combination (a) and FIG. 4 shows a program for checking the combination (c).

In FIG. 3, the program may be executed for each cycle of engine revolution, for example. After determining a reference engine speed with respect to various control parameters, such as the coolant temperature, crank angle signal, neutral position, the vehicle condition is checked with respect to factors I to VI. Upon execution of the program, first, the throttle valve angle sensor signal is checked to detect the entirely closed position of the throttle, in a decision block 202. When the decision at the block 202 is YES, whether the transmission is in neutral is checked, in a decision block 204. If the decision in block 204 is YES, then whether a given transient delay time has expired is checked, in a decision block 208. If the decision in the block 204 is NO, then whether the vehicle speed is less than 8 km/h is checked, in a decision block 206. If the decision in the block 206 is YES, then the operation also skips to the block 208 to check expiration of the given transient delay time. When the decision in the block 208 is YES, then feedback control is started.

If the decision in the block 202 is NO, then feedback control is stopped and all the flags and timers for use with feedback control are reset in a block 210. If the decision of the block 208 or 206 is NO or after operation of the block 210, open loop control is carried out. It will be understood from FIG. 3 that when the transmission is in neutral, the vehicle is naturally stationary. Therefore, when the block 20 decides YES, it is unnecessary to check the vehicle speed.

In the above-mentioned program, feedback control will be performed under the condition:

FACTOR I AND (FACTOR II OR FACTOR III) AND FACTOR IV.

Now referring to FIG. 4, there is illustrated another program for discriminating the engine condition, wherein the block 208 in FIG. 3 is replaced by a block 212, which determines whether the fuel supply is shut off. The remainder is substantially the same as illustrated and explained with respect to FIG. 3, and therefore it is unnecessary to explain further here.

In the program shown in FIG. 4 is discriminated the engine condition, and when the combination (c) is satisfied, feedback control is performed.

It will be understood that, there are various ways of discriminating the engine condition. Therefore, the specific embodiments as mentioned with reference to FIGS. 3 and 4 are merely embodiments and it will be possible to embody otherwise. Hereinafter illustrated is a modification of the method for discriminating the engine condition.

In the modified embodiment, in addition to FACTOR I to FACTOR VI, the following factors are checked for discrimination of engine condition:

FACTOR VII: the actual engine speed $N_{RPM}$ is less than the reference engine speed $N_{SET}$, i.e. $\Delta N<0$ ($\Delta N=N_{RPM}-N_{SET}$);

FACTOR VIII: the actual engine speed $N_{RPM}$ is more than the reference engine speed $N_{SET}$, i.e. $\Delta N<0$;

FACTOR IX: the difference $\Delta N$ between the actual engine speed $N_{RPM}$ and the reference engine speed $N_{SET}$ is less than a given negative value, for example, −25 r.p.m.;

FACTOR X: the difference $\Delta N$ between the actual engine speed $N_{RPM}$ and the reference engine speed $N_{SET}$ is more than a given value, for example, 25 r.p.m.; and FACTOR XI: actual intake air flow rate Q is less than a given minimum rate $Q_{min}$.

Further, the FACTOR IV is divided into two different factors, such as:

FACTOR IV-1: after the feedback condition is satisfied, a first given time; for example, 1 second, has elapsed; and FACTOR IV-2: after the feedback condition is satisfied, a second given time which is longer than the first given time, e.g. 4 seconds, has elapsed.

FACTORs IV-1 and IV-2 will be selectively checked corresponding to other factors of the engine condition. FACTORs VII and VIII indicate opposite conditions respectively indicating control requirements of increasing and decreasing the atual engine speed $N_{RPM}$ to match the same to the reference engine speed $N_{SET}$. With respect to these factors, the different discriminating operations will be carried out and the required engine condition is varied. As an explanation, compare the following two cases.

(A) FACTOR I AND FACTOR VII (B) (FACTOR I AND FACTOR IV-2) AND {(FACTOR II OR FACTOR III) AND FACTOR IV-1} AND FACTOR VIII.

In the above conditions, (A) is a case where the engine speed is to be increased and (B) is a case where the engine speed is to be decreased. Feedback control will be carried out on expiration of the time delays given by FACTOR IV-2 and FACTOR IV-1 after FACTOR I AND FACTOR II or FACTOR III are respectively satisfied and when FACTOR III is satisfied. FACTORs IV-1 and IV-2 give delay times for decreasing the engine speed. Namely, when the engine speed is to be increased, i.e. the difference $\Delta N$ is negative, feedback control is carried out very shortly after the throttle valve entirely closed. On the other hand, when the engine speed is to be descreased, the feedback control will be carried out, when all the following conditions are fulfilled:

first: the throttle valve is entirely closed;

second: after the throttle valve is closed, a 4 second time delay expires;

third: the transmission is in neutral position or the vehicle speed is less than 8 km/h;

fourth: after the third condition is fullfilled, a 1-second time delay expires; and fifth: the actual engine speed $N_{RPM}$ is more than the reference engine speed $N_{SET}$.

When it is required to increase the engine speed, i.e., the actual engine speed $N_{RPM}$ is less than the reference engine speed $N_{SET}$, the engine may stall because of a lack of engine speed, and therefore it is necessary to increase the engine speed rapidly. Further, there is no danger in rapidly increasing the engine speed. Therefore, it is possible to carry out feedback control immediately after the combination (A) is fullfilled. On the other hand, when the engine speed is required to be decreased, i.e., the actual engine speed $N_{RPM}$ is more than the reference engine speed $N_{RPM}$, a rapid decrease of engine speed may cause the engine to stall. Therefore, in this case, the time delay is required for safety.

In combination (A), FACTOR VII can be replaced by FACTOR XI, i.e., the combination (A) can be replaced by FACTOR I AND (FACTOR VII OR FACTOR IX) . . . (C). Meanwhile, the combination (B) can be replaced any one of the following:

(D) {[FACTOR I AND (FACTOR II OR FACTOR V)] AND FACTOR IV-1} AND FACTOR VIII (E) [FACTOR I AND (FACTOR II OR FACTOR III) AND FACTOR VIII] AND FACTOR IV-1; and (F) FACTOR I AND (FACTOR II OR FACTOR III) AND FACTOR VIII AND FACTOR VI.

In combination (C), feedback control is carried out when the throttle valve is entirely closed and the actual engine speed $N_{RPM}$ is less than the reference engine speed $N_{SET}$ or the intake air flow rate Q is less than the given minimum rate $Q_{min}$. In combination (D), the feedback control is carried out when the following conditions are fulfilled:

first: the throttle valve is entirely closed, and the transmission is in neutral position or the clutch switch is turned on;

second: after fulfilling the first condition, a 1 second time delay elapses; and third: the actual engine speed $N_{RPM}$ is more than the reference engine speed $N_{SET}$.

In combination (E), feedback control is carried out when the following conditions are fulfilled:

first: the throttle valve is entirely closed, the actual engine speed $N_{RPM}$ is more than the reference engine speed $N_{SET}$, and, the transmission is in neutral position or the vehicle speed is less than 8 km/h; and second: a 1-second delay time expires.

In the combination (F), the feedback control is taken place when the following conditions are fulfilled:

the throttle valve is entirely closed;

the transmission is in neutral position or the vehicle speed is less than 8 km/h;

the actual engine speed $N_{RPM}$ is more than the reference engine speed $N_{SET}$; and the fuel supply is not shut off.

In the meanwhile, when the engine is idling, the engine speed frequently varies within a relatively small difference with respect to the reference engine speed. In this condition, even though the actual engine speed $N_{RPM}$ is slightly different from the reference engine speed $N_{SET}$, the engine can be regarded as correctly controlled. In this case, it is unnecessary to control the actual engine speed corresponding to the reference engine speed by feedback control. If the control operation follows such a small difference between the actual engine speed and the reference engine speed, the control signal will be frequently varied according to changes of the actual engine speed so as to perform unnecessary and not so effective control. Therefore, it is preferable to allow a certain range of the actual engine speed within which corrections are not made, to provide a husteresis effect. In the shown embodiment, a dead band of, for example, 25 r.p.m. is defined 25 r.p.m. on either side of the reference engine speed $N_{SET}$. The FACTORs IX and X are, therefore, provided so as to determine whether the actual engine speed is in the dead band. According to the above consideration, there are provided for example the following twelve combinations:

(A) FACTOR I AND FACTOR VII;
(A') FACTOR I AND FACTOR IX;
(B) FACTOR I AND FACTOR IV-2 AND {(FACTOR II OR FACTOR III) AND FACTOR IV-1} AND FACTOR VIII;
(B') FACTOR I AND FACTOR IV-2 AND [FACTOR II OR FACTOR III) AND FACTOR IV-1] AND FACTOR X;
(C) FACTOR I AND (FACTOR VII OR FACTOR XI);
(C') FACTOR I AND (FACTOR IX OR FACTOR XI);
(D) {[FACTOR I AND (FACTOR II OR FACTOR V)] AND FACTOR IV-1} AND FACTOR VIII;
(D') {[FACTOR I AND (FACTOR II OR FACTOR V)] AND FACTOR IV-1} AND FACTOR X;
(E) {FACTOR I AND (FACTOR II OR FACTOR III) AND FACTOR VIII} AND FACTOR IV-1;
(E') {FACTOR I AND (FACTOR II OR FACTOR III) AND FACTOR X} AND FACTOR IV-1;
(F) FACTOR I AND (FACTOR II OR FACTOR III) AND FACTOR VIII AND FACTOR VI; and
(F') FACTOR I AND (FACTOR II AND FACTOR III) AND FACTOR X AND FACTOR VI.

In the above combinations, the combinations (A), (A'), (C) and (C') correspond to cases where the engine speed is to be increased and the remainder correspond to cases where the engine speed is to be decreased. It will be noted that in the above-mentioned combinations, the FACTORs II, III and V are substantially similar factors indicative of at least the engine not being in the engine braking state. Therefore, any one of the factors can be checked for determining the feedback condition.

As above, when the engine control is changed from the feedback control to open loop control, it is of course possible to discriminate the condition by discriminating one or more factors not being adapted to perform feedback control. However, in practice, when the control changes from feedback to open loop, first FACTOR I will change so as not to be adapted to feedback control and the remainder will change following the change in FACTOR I. Therefore, indeed, it is possible to detect the engine condition to be controlled by open loop by merely discriminating the FACTOR I not being satisfied. If necessary, FACTOR III may be checked in addition to FACTOR I so as to check if the vehicle is moving by inertia and so on without application of accelerator.

In open loop control, the minimum value of the reference speed is restricted to a relatively high value to prevent the possibility of stalling. Therefore when control changes from feedback to open loop, the speed setting of the engine may rise suddenly. To present this, when the control is changed from feedback control to open loop control and when the control value in the feedback control is less than the minimum value for open loop control, the control value is increased only gradually at a given rate and a given timing, for example, increasing 0.5% for 128 cycles of engine revolution.

Figure 5:
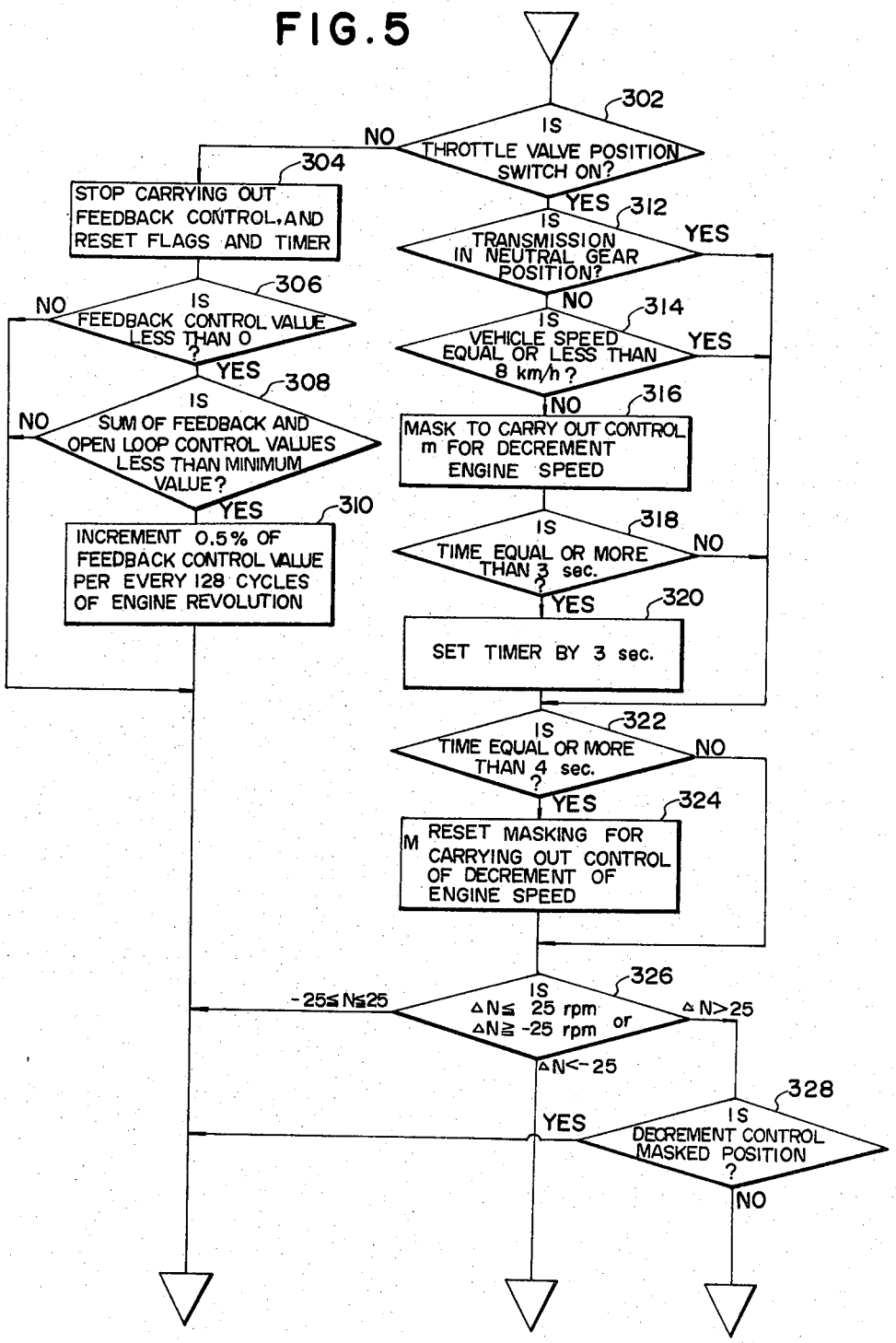
FIG. 5 is a flow chart of a program for discriminating the engine driving condition and thereby for carrying out feedback control and open loop control selectively according to a second embodiment of the present invention, wherein a dead band of control operation is defined with respect to a difference between an actual engine speed and the reference engine speed.

In FIG. 5 is illustrated a flowchart of a program according to another embodiment of the present invention to operate the above-mentioned discrimination of the feedback control condition. In FIG. 5, as the programs shown in FIGS. 3 and 4, this program is executed per 1 cycle of engine revolution. At first, the throttle valve position is checked with respect to the throttle valve angle sensor signal, in a decision block 302. When the throttle valve is not entirely closed position and therefore the throttle valve position switch turns off, the feedback control is stopped in a block 304. Then, in block 304, flags and timers for use with the feedback control operation are cleared. Thereafter, the final control value determined by the feedback control operation is checked whether the control value is to decrease the actual engine speed $N_{RPM}$, in a decision block 306. If the decision of the block 306 is YES, then the sum of the control values by the feedback control and the open loop control is checked whether it is less than the minimum value, in a decision block 308. If the decision of the block 308 is YES, the control value is increased by 0.5% per 128 cycles of the engine revolution, in a block 310. Blocks 308 and 310 are provided to prevent the control value from increasing too much when the control is switched from the feedback control to the open loop control. After the operation of block 310, or if the decision of either one of the blocks 306 or 308 is NO, then the open loop control is started.

On the other hand, if the throttle valve is entirely closed and thereby the throttle valve position sensor turns ON, and, therefore, the decision of the block 302 is YES, the transmission gear position is checked whether it is in neutral range, in a decision block 312. If the decision of the block 312 is NO, the vehicle speed is checked whether it is equal to or less than 8 km/h, at a decision block 314. If the vehicle speed is more than 8 km/h and, therefore, the decision of the block 314 is NO, control operation decreasing of the actual engine speed $N_{RPM}$ is masked at a block 316. When the decreasing control is masked, a time measured by a timer which measures transient delay time, is checked whether it is equal to or more than 3 seconds, at a decision block 318. When the time exceeds 3 seconds, the timer is set to 3 seconds at a block 320. Thereafter, the time of the timer is checked again, whether it is equal to or more than 4 seconds, in a decision block 322. If the decision of the block 322 is YES, the masking of control operation for decreasing the engine speed is reset in a block 324. Then, the difference $\Delta N$ of the actual engine speed $N_{RPM}$ and the reference engine speed $N_{SET}$ is checked in a decision block 326.

When the decision of either of the blocks 312 and 314 is YES, control jumps to the decision block 322. Likewise, if the decision of the block 318 is NO, control also jumps to the block 322. When the decision of the block 322 is NO, control jumps to the block 326. In the decision block 326, the difference $\Delta N$ is checked whether it is equal to or more than 25 r.p.m. and also whether it is equal to or less than −25 r.p.m. If the difference $\Delta N$ is more than 25 r.p.m., at a decision block 328 is checked whether control operation to decrease the engine speed is masked. If the decision of the block 328 is YES, then the control is made by open loop control. However, if the decision of the block 28 is NO, feedback control is used to decrease the actual engine speed $N_{RPM}$ to adapt the same to the reference engine speed $N_{SET}$. If the difference $\Delta N$ is less than −25 r.p.m., then feedback control starts to increase the actual engine speed $N_{RPM}$ to match the reference engine speed $N_{SET}$. On the other hand, if the difference $\Delta N$ is in a range between −25 r.p.m. to 25 r.p.m., namely it is in a dead band, open loop control is also carried out.

In the above described program, each of the foregoing factors is checked, as follows:

FACTOR I is checked at the block 302;
FACTOR II is checked at the block 312;
FACTOR III is checked at the block 314;
FACTOR IV-1 is checked at the block 318;
FACTOR IV-2 is checked at the block 322; and
FACTOR IX and FACTOR X are checked at the block 326.

Therefore, when the FACTOR I is not satisfied, open loop control is carried out. Likewise, if both FACTOR II and FACTOR III are not satisfied, open loop control is carried out. Further, if neither of FACTOR IX and FACTOR X is satisfied, open loop control is carried out. When either one of following combinations is satisfied, feedback control is carried out:

FACTOR I AND FACTOR IX
FACTOR I AND FACTOR IV-2 AND {(FACTOR II OR FACTOR III) AND FACTOR IV-1} AND FACTOR X

According to the present invention, by varying the combination to perform the feedback control for increasing and decreasing the engine speed, the control operation can be switched stably between feedback control and open loop control. Further, therefore, it can effectively prevent stalling upon changing the control operation.

While, however the specific construction are disclosed hereabove for illustration of the present invention, it will be possible to make various modifications to various features or elements consisting of the present invention. Therefore, the present invention should not be limited to the specific embodiment of the present invention and should be understood to include any modifications without departing from the principle of the present invention.

What is claimed is:

1. In an automotive vehicle having an internal combustion engine and a transmission, said engine having an air intake passage with a throttle valve therein, an engine idling speed control system, comprising:

a bypass passage which bypasses said throttle valve;
means for controlling flow rate of intake air flowing through said bypass passage;
first sensor means for detecting engine speed;
second sensor means for detecting a first parameter indicative of a fully closed position of said throttle valve;
a microcomputer including third sensor means for detecting predetermined engine driving conditions indicative of a stable driving condition of said internal combustion engine, whereat parameters of controlling engine idling speed are generally at a steady state condition, said predetermined engine conditions including at least one of second, third and fourth parameters, said second parameter being a neutral gear position of said transmission, said third parameter being a vehicle speed less than a given speed, and the fourth parameter being fuel supply in other than a fuel shut off condition; and
said microcomputer closed loop controlling said controlling means based on said engine speed detected by said first sensor means when said second and third sensor means detect said first parameter and said stable driving condition, respectively, and for otherwise open loop controlling said controlling means.

2. A control system as set forth in claim 1, further comprising a timer for measuring a time after said second and third means detect said first parameter and said stable driving condition respectively, said microcomputer responsive to said timer and operative only after said given time period to effect feedback control.

3. A control system as set forth in claim 1 or 2, wherein said microcomputer calculates a difference between a predetermined reference engine speed based on at least one engine parameter and the actual engine speed from said first sensor means, and wherein if said difference is in a given range, said microcomputer effects open loop control even when said second and third sensor means detect said first parameter and stable driving condition respectively.

4. A control system as set forth in claim 1 or 2, wherein said third sensor means detects neutral gear position of a vehicle transmission.

5. A control system as set forth in claim 1 or 2, wherein said third sensor means detects the vehicle speed being less than a given speed.

6. A control system as set forth in claim 5, wherein said given vehicle speed is 8 km/h.

7. A control system as set forth in claim 2, wherein said given time is 4 seconds.

8. A control system as set forth in claim 1, wherein said microcomputer determines said stable driving condition from any one of said second, third and fourth parameters, said microcomputer selecting any one of said second to fourth parameters corresponding to relationship between said reference engine speed and said actual engine speed.

9. In an automotive vehicle having a transmission and an internal combustion engine having an air intake passage with a throttle valve therein, including a bypass passage bypassing said throttle valve and means for controlling the bypass air flow rate through said bypass passage, a method for closed loop controlling engine idling speed comprising:

detecting engine speed;
detecting a fully closed position of said throttle valve;
detecting a predetermined stable engine driving condition in which the engine condition is adapted to carry out closed loop control and which is defined by at least one preselected engine operation parameter including (a) a neutral gear position of the transmission, (b) vehicle speed being less than a given speed and (c) fuel supply being in other than a shut off condition;
closed loop controlling said controlling means based on said engine speed detected in the first step when said throttle valve is in the fully closed position and the stable driving condition is detected; and
open loop controlling said controlling means when other than the stable engine driving condition is detected.

10. A method as set forth in claim 9, wherein said method further includes a step for determining a difference between a reference engine speed according to at least one engine condition and an actual engine speed so that if the determined difference is in a given range, closed loop control is not carried out even when said fully closed position of the throttle valve and stable driving condition of said internal combustion engine are detected.

11. A method, as recited in claim 9, wherein said first given time is 1 second and said second given time is 4 seconds.

12. A method, as recited in claim 9, wherein said given vehicle speed is 8 km/h.

* * * * *